US006131548A

United States Patent [19]

Yano

[11] Patent Number: 6,131,548

[45] Date of Patent: Oct. 17, 2000

[54] FUEL SYSTEM

[75] Inventor: Masaaki Yano, Nishikamo-gun, Japan

[73] Assignee: Toyota Jidosha Kabushiki Kaisha, Toyota, Japan

[21] Appl. No.: 09/261,539

[22] Filed: Mar. 3, 1999

[30] Foreign Application Priority Data

May 22, 1998 [JP] Japan ..... 10-141243

[51] Int. Cl.[7] ..... F02M 37/04

[52] U.S. Cl. ..... 123/456; 123/514; 123/381

[58] Field of Search ..... 123/381, 497, 123/357, 456, 541, 41.31, 514

[56] References Cited

U.S. PATENT DOCUMENTS

| | | | |
|---|---|---|---|
| 3,935,851 | 2/1976 | Wright | 123/497 |
| 4,522,177 | 6/1985 | Kawai | 123/381 |
| 4,718,391 | 1/1988 | Rembold | 123/381 |
| 4,800,859 | 1/1989 | Sagisaka | 123/497 |
| 4,823,757 | 4/1989 | Redele | 123/381 |
| 4,920,942 | 5/1990 | Fujimori | 123/497 |
| 4,951,636 | 8/1990 | Tuckey | 123/497 |
| 4,955,345 | 9/1990 | Brown | 123/381 |
| 5,501,196 | 3/1996 | Brunnhofer | 123/497 |
| 5,542,395 | 8/1996 | Tuckey | 123/381 |

FOREIGN PATENT DOCUMENTS

| | | |
|---|---|---|
| 5-33741 | 2/1993 | Japan . |
| 5-240122 | 9/1993 | Japan . |
| 6-58219 | 3/1994 | Japan . |
| 6-323220 | 11/1994 | Japan . |

*Primary Examiner*—Carl S. Miller
*Attorney, Agent, or Firm*—Kenyon & Kenyon

[57] ABSTRACT

A temperature distribution of fuel flowing through a delivery pipe is detected by two fuel temperature sensors provided in the delivery pipe and a fuel tank. When this temperature distribution exceeds an allowable range, adjusted pressure pumping processing in which an amount of fuel corresponding to an injection amount is pumped is stopped and quantitative pressure pumping processing is begun. In quantitative pressure pumping, a rate of fuel flowing through the delivery pipe is increased to an amount exceeding an amount of fuel injected from injectors. With this feature, an amount of fuel flowing through the delivery pipe is greatly increased, a temperature rise rate due to thermal energy from the engine is lowered, and the range of temperature distribution of fuel is narrowed down as a whole. Therefore, differences in output torque among the cylinders is reduced, and variations in the revolution of the engine are suppressed or prevented.

15 Claims, 8 Drawing Sheets

FUEL SYSTEM

INCORPORATION BY REFERENCE

The disclosure of Japanese Patent Application No. HEI 10-141243 filed on May 22, 1998 including the specification, drawings and abstract is incorporated herein by reference in its entirety.

BACKGROUND OF THE INVENTION

1. Field of the Invention

The present invention relates to a system for supplying fuel to the cylinders of an internal combustion engine such as a gasoline engine or a diesel engine.

2. Description of the Related Art

In an internal combustion engine including a plurality of cylinders, fuel distributor pipes such as delivery pipes (also called a common rail) are known for supplying fuel directly or indirectly (through a precombustion chamber or an intake port) to the respective cylinders.

Such fuel distributor pipes serve to distribute fuel fed under high pressure from a fuel pump as a fuel supply source to fuel injection valves provided in the respective cylinders.

To carry out the above function, since the fuel distributor pipes are provided in the vicinity of the internal combustion engine, they are likely to be influenced by heat generated in the internal combustion engine. That is, the fuel supplied to the fuel distributor pipe is heated, increasing its temperature.

This increase in the fuel temperature becomes greater as the time required for the fuel to pass through a fuel path of the fuel distributor pipe becomes longer. These fuel distributor pipes have different branch positions from which fuel is supplied to the respective cylinders. Accordingly the temperature of the fuel supplied to the respective cylinders may vary from cylinder to cylinder.

The fuel injection valves for injecting the fuel distributed from the fuel distributor pipes adjusts the amount of the fuel to be supplied to the respective cylinders according to its opening degree. The fuel injection valves adjust a fuel amount according to volume, not weight. Therefore as a fuel temperature is increased, an amount of fuel supplied to a cylinder is decreased owing to thermal expansion of the fuel.

If the temperature of fuel supplied to each cylinder is increased at the same rate, the fuel amount can be corrected using feedback control, which causes no problem. If the fuel temperature varies depending on the cylinder to which the fuel is supplied, the fuel amount cannot be corrected with respect to all cylinders. This may result in a failure to supply the correct amount of the fuel to each of the respective cylinders.

As a result, output torque varies depending from cylinder to cylinder, which may cause variations in the revolution of the internal combustion engine.

Japanese Patent Application Laid-open No. HEI 5-240122 discloses a technique for reducing difference in fuel temperature between two delivery pipes disposed in each bank of a V-type 6-cylinder internal combustion engine. This technique however, is effective for reducing differences in the fuel temperature between different delivery pipes but not for reducing differences in fuel temperature between cylinders in the same delivery pipe. This technique fails to suppress or prevent variation in the revolution of the internal combustion chamber owing to the difference in the fuel temperature among cylinders.

Japanese Patent Application Laid-open No. HEI 6-323220 discloses a technique for fuel supply to a delivery pipe between third and fourth cylinders of a 6-cylinder internal combustion engine, and Japanese Patent Application Laid-open No. HEI 6-58219 discloses a technique for fuel supply to both sides of a delivery pipe of a 6-cylinder internal combustion engine. The aforementioned techniques, however, fail to sufficiently suppress or prevent variation in revolution of the internal combustion engine. Further, Japanese Patent Application Laid-open No. HEI 5-33741 discloses a technique for cooling the fuel that has not been injected through the injector and returned to the fuel tank. However, this technique fails to overcome the difference in the fuel temperature among cylinders, which cannot suppress or prevent variation in revolution.

SUMMARY OF THE INVENTION

It is an object of the present invention to suppress or prevent variation in the revolution of an internal combustion engine owing to variations in temperature of the fuel supplied to the respective cylinders.

A fuel system of a first aspect of the present invention includes a fuel distributor pipe having a relief valve for discharging excessive fuel, the fuel distributor pipe distributing and supplying fuel from a fuel supply source to a plurality of cylinders, fuel temperature distribution detecting means for detecting a temperature distribution of fuel in the fuel distributor pipe; and fuel flow rate adjusting means which increases a rate of flow supplied from the fuel supply source to the fuel distributor pipe when a distribution of fuel temperature detected by the fuel temperature distribution detecting means exceeds an allowable range, as compared to a flow rate set when the temperature distribution does not exceed the allowable range.

If the temperature distribution of the fuel flowing through the fuel distributor pipe which has been detected by the fuel temperature distribution detection means exceeds the allowable range, the fuel flow rate adjusting means increases the fuel flow rate in comparison to the case where the temperature distribution does not exceed the allowable range. With this feature, the calorific power from the internal combustion engine is absorbed by a large amount of fuel, thus reducing the increase in fuel temperature flowing in the fuel distributor pipe. As a result, the range of the temperature distribution of the fuel, as a whole, can be reduced.

Accordingly a difference in output torque among to cylinders is reduced, thus suppressing or preventing variation in revolution of the internal combustion engine.

In the first aspect of the present invention, the fuel flow rate adjusting means causes the fuel flow rate to be supplied from the fuel supply source to the fuel distributor pipe to correspond to a fuel amount required by the cylinders when the detected temperature distribution of fuel does not exceed the allowable range, and the fuel flow rate adjusting means increases the fuel flow rate to a higher rate corresponding to an amount of fuel greater than that required by the plurality of cylinders when the detected temperature distribution exceeds the allowable range.

Assuming that the flow rate of the fuel to be used for combustion in all cylinders is set as a reference value, the fuel flow rate adjusting means is allowed to increase the flow rate to be greater than the reference value. When the flow rate of the fuel exceeds the reference value, the excessive amount can be discharged through a relief valve. Therefore a large amount of fuel, more than the required amount, can be distributed within the fuel distributor pipe.

Further, fuel flow rate judgment means may be provided for judging whether the fuel flow rate adjusting means causes the fuel flow rate pipe to correspond to the fuel amount required by the plurality of cylinders, in which the allowable range is varied with the judgment result by the fuel flow rate judgment means.

In the foregoing, even if the fuel temperature in the fuel distributor pipe is decreased resulting from an increase in the amount of fuel supplied thereto, it is possible to suppress hunting for the fuel flow rate, thus suppressing variation in revolution swiftly.

Further, the relief valve is mounted at one end of the fuel distributor pipe, and fuel supplied from the fuel supply source is received by the other end of the fuel distributor pipe.

Thus the supply side and discharge side may allow smooth flow of the fuel in the fuel distributor pipe, by which the fuel temperature distribution therein can be reduced, leading to decreased variation in revolution of the internal combustion engine.

In the first aspect of the invention, the fuel system according to the second aspect of the invention includes a fuel supply portion for supplying fuel to the fuel distributor pipe such that a temperature of fuel distributed to the plurality of cylinders follows two paths and the cylinders at the respective temperature patterns are arranged alternately, as an ignition order. The fuel supply portion supplies fuel to the fuel distributor pipe from a position where a temperature difference of fuel supplied to a cylinder a and a preceding cylinder b has a small difference in absolute value and the opposite sign of a temperature difference between fuel supplied to the cylinder a and a subsequent cylinder c.

As described above, when the cylinders are ignited in an order such as "cylinder b-cylinder a-cylinder c . . . ", if a difference in output torque between the cylinder b and the cylinder a due to the fuel temperature difference, and a difference in output torque between the cylinder b and the cylinder c have the same absolute values each having opposite signs (i.e., the difference is small or 0), the output torque repeats a cycle such as "large-small-large . . . " or "small-large-small . . . ". In the aforementioned repetition, a cycle of variation in the output torque is shortened, and the revolution variation in the internal combustion engine becomes less influential.

If the absolute value of a difference between the temperature difference between the cylinder a and the preceding cylinder b and the temperature difference between the cylinder a and the subsequent cylinder c is increased, the output torque repeats such cycle as "large-medium-small . . . ", "small-medium-large", "large-large-small . . . " or "small-small-large . . . ". In such a repetition, the variation cycle of the output torque is elongated, which might reflect on the revolution variation in the internal combustion engine. The revolution variation, thus, cannot be suppressed.

Therefore, if the fuel temperature difference between the cylinder a and the preceding cylinder b differs from the fuel temperature difference between the cylinder a and the subsequent cylinder c by a small amount in absolute value (including when the difference is equal to 0) although these difference values have opposite signs, the revolution variation can be suppressed or prevented.

In the second aspect, the fuel distributor pipe mounted in a four-cylinder internal combustion engine for fuel distribution to four cylinders, and the fuel supply portion supplies fuel from both sides of the fuel distributor pipe.

Assuming that fuel is supplied from both sides of the fuel distributor pipe in a four-cylinder internal combustion engine, two kinds of temperature of the cylinders will be arranged as "low-high-low-high" on the fuel distributor pipe, but the order of ignition will be as "low-high-low-high", and a difference in fuel temperature between adjacent cylinders will be as "(+large) (−large) (+large) . . . ". Therefore, the revolution variation in the internal combustion engine can be suppressed or prevented. Assuming that the fuel is supplied from both sides of the fuel distributor pipe in a six-cylinder internal combustion engine, three patterns of temperature will be cycled as "low-medium-high-high-medium-low", and the difference in the fuel temperature between adjacent cylinders will not be cycled as "(+large) (−large) (+large) . . . " in arbitrary ignition order. Therefore the revolution variation in the internal combustion engine cannot be suppressed or prevented.

Further in the second aspect, the fuel distributor pipe mounted in a four-cylinder internal combustion engine for fuel distribution to four cylinders, and the fuel supply portion supplies fuel to the fuel distributor pipe from an intermediate position that divides the four cylinders into two groups each containing two cylinders.

In the first aspect, a fuel system of a third aspect according to the present invention includes a fuel supply portion for supplying fuel from one end of the fuel distributor pipe; and a fuel branch portion leading to each of the cylinders which is located opposite to the fuel supply portion in a fuel path of the fuel distributor pipe.

At an initial stage, the fuel temperature rises in the delivery pipe at a relatively high rate. Such rate is gradually decreased to stop the temperature increase. That is, as the time required for the fuel to flow in the fuel distributor pipe becomes longer, the temperature becomes more stable. The temperature hardly rises.

Therefore, if the fuel branch potions are disposed at the side opposite to the fuel supply portion in the fuel path of the fuel distributor pipe, a distance from an inlet of the fuel distributor pipe to the fuel branch portion is elongated. The fuel can be sufficiently heated during the flow such that the temperature of the fuel supplied from the respective branch portions to the corresponding cylinders hardly rises. Therefore, the temperature distribution of the fuel supplied to the respective cylinders is minimized, and the revolution variation in the internal combustion engine can be suppressed or prevented.

Further, in the third embodiment, the fuel path in the fuel distributor pipe is formed into a U-like shaped to have a bent portion at an intermediate part thereof, and all of the fuel branch portions are disposed downstream from the bent portion.

This feature makes it possible to elongate the fuel path without changing the length of the fuel distributor pipe, and the fuel is heated to a sufficient temperature in the course of flowing through a relatively long fuel path from the fuel supply portion to the bent portion. Thereafter, the temperature rises at a relatively lower speed. Therefore, each temperature rise of the fuel flowing from the respective branch portions to the corresponding cylinders can be further reduced. The temperature distribution of the fuel to be supplied to the respective cylinders, thus, can be reduced. As a result, the revolution variation in the internal combustion engine can be suppressed or prevented.

In the aforementioned third aspect, the present invention is structured such that the fuel is sufficiently heated before reaching the fuel branch portions instead of cooling the fuel that has been entered into the fuel distributor pipe. This may reduce the temperature distribution, thus suppressing or preventing the revolution variation in the internal combustion engine is suppressed or prevented.

A fuel supplying apparatus of a fourth embodiment of the present invention includes a fuel supply portion for supplying fuel to the fuel distributor pipe; and cooling means mounted on an outer surface of the fuel distributor pipe, exhibiting ability for cooling fuel within the fuel distributor pipe enhanced as a distance from the fuel supply portion increases.

Since the fuel is substantially cooled by the cooling means as it flows away from the fuel supply portion, the temperature of the fuel flowing through the fuel distributor pipe rises at a relatively slow rate. The resultant temperature distribution of the fuel delivered to the respective cylinders can be reduced, thus suppressing or preventing the revolution variation in the internal combustion engine.

Further in the fourth embodiment, the cooling means may be formed as a cooling fin having a surface area enlarged as it gets away from the fuel supply portion.

In the fourth embodiment, the cooling means is disposed such that a part of a circulating path for coolant is located so as to be thermally conducted to the fuel distributor pipe, and fuel in the fuel distributor pipe is cooled by a heat exchanger disposed in a part of the circulation path. In the aforementioned structure, the heat absorbed by the coolant from the fuel distributor pipe can be discharged by the heat exchanger so as to retard the temperature rise in the fuel flowing in the fuel distributor pipe. As a result, the temperature distribution of the fuel delivered to the respective cylinders is reduced, thus suppressing or preventing the revolution variation in the internal combustion engine.

In the fourth embodiment, the present invention may employ, instead of the cooling means, the heat insulator which is disposed on the outer surface of the fuel distributor pipe and exhibits heat-insulating ability that may be intensified as it moves away from the fuel supply portion, or heat transmitting means which is disposed on the outer surface of the fuel distributor pipe and exhibits heat-transmitting ability that may be intensified as it approaches the fuel supply portion.

DETAILED DESCRIPTION OF THE PREFERRED EMBODIMENTS

First Embodiment

Figure 1:
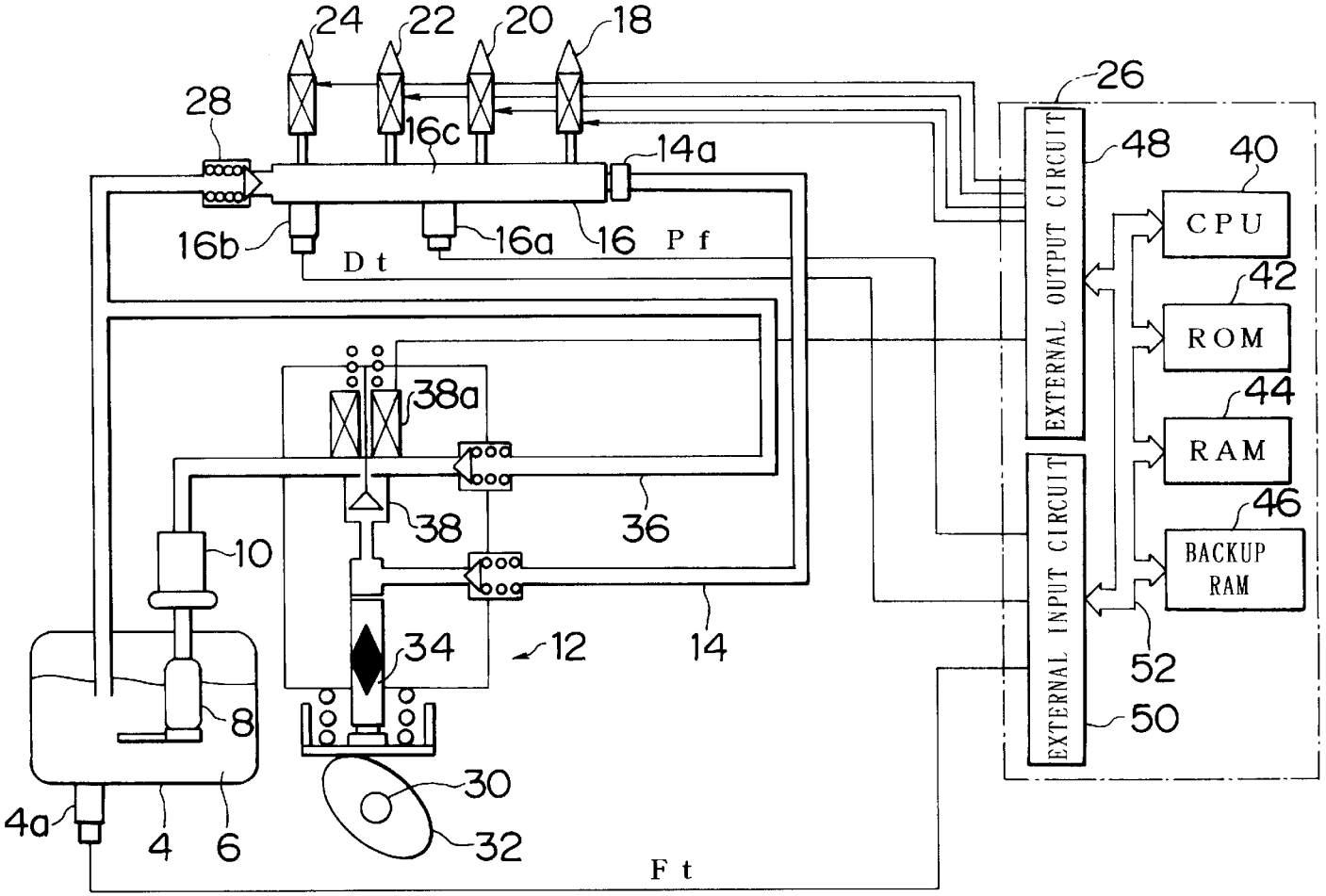
FIG. 1 is a block diagram of a fuel system of a first embodiment applied to a four-cylinder gasoline engine.

FIG. 1 is a block diagram of a fuel system of the present invention applied to a four-cylinder gasoline engine.

Referring to FIG. 1, fuel 6 in a fuel tank 4 is pumped up by a feed pump 8 to a high pressure supply pump 12 through a filter 10. The fuel is highly pressurized by the high pressure supply pump 12 and is supplied from a fuel supply path 14 through a fuel supply portion 14*a* to one end of a fuel distributor path 16*c* of a delivery pipe 16 (corresponding to a fuel distributor pipe).

The high pressure fuel in the fuel distributor path 16*c* is directly injected into each of four cylinders (not shown) through injectors 18, 20, 22 and 24 provided therein. Both the valve opening timing and the valve opening period of each of the injectors 18, 20, 22, 24 are adjusted by an electronic control unit (hereinafter referred to as ECU) 26 in accordance with a driving state of the gasoline engine.

A relief valve 28 is disposed at one end of the fuel distributor path 16*c*, which is opposite to the fuel supply portion 14*a*. When an amount of fuel larger than the injection amounts of the injectors 18, 20, 22, 24 is supplied from the high pressure supply pump 12 to the delivery pipe 16, the relief valve 28 discharges the excessive fuel to the fuel tank 4.

The high pressure supply pump 12 includes a pump cam 32 mounted to a shaft (a cam shaft for an intake valve or an exhaust valve) 30 which is rotatably interlocked with the revolution of a crankshaft of the gasoline engine, a piston 34 reciprocated by the pump cam 32, and an electromagnetic discharge amount control valve (hereinafter referred to as PCV) 138 which determines whether the fuel forced out by the piston 34 is supplied to the fuel supply path 14, or returned to the fuel tank 4 through a return path 36.

The delivery pipe 16 is provided with a fuel pressure sensor 16*a* and a fuel temperature sensor 16*b*. The fuel temperature sensor 16*b* is disposed in the vicinity of a fuel branch portion connected to the injector 24 furthest from a side to which the fuel is supplied from the fuel supply path 14. The fuel tank 4 is provided with a fuel temperature sensor 4*a*.

The ECU 26 is formed of a central processing unit (CPU) 40, a read-only memory (ROM) 42 in which a predetermined program, map and the like are previously stored, a random-access memory (RAM) 44 for temporarily storing the calculation result of the CPU 40, a back up memory (back up RAM) 46 for retaining previously stored data and the like. The ECU 26 further includes an external output circuit 48 for outputting driving signal to electromagnetic valves of the injectors 18, 20, 22, 24 and the PCV 38, and an external input circuit 50 for inputting signals from the fuel pressure sensor 16*a* and the fuel temperature sensor 16*b* and the fuel temperature sensor 4*a* provided in the fuel tank 4. The aforementioned elements 40 to 46 are connected to the external output circuit 48 and the external input circuit 50, respectively through a bus 52.

The CPU 40 executes processing based on the program and data stored in the ROM 42. Here, the CPU 40 executes a control for supplying fuel to the delivery pipe 16 by the high pressure supply pump 12, a control of fuel injection timing and fuel injection amount through the injectors 18, 20, 22, 24.

Most particularly, the fuel supply control executes the adjusted pressure pumping processing and quantitative pressure pumping processing.

In the adjusted pressure pumping processing, the opening timing of the PCV 38 is adjusted based on the fuel pressure and the fuel injection amount detected by the fuel pressure sensor 16*a* in a pumping stroke of the piston 34 caused in accordance with revolution of the pump cam 32. This may maintain the fuel pressure in the fuel distributor path 16*c* at a pressure necessary for fuel injection by the fuel pressure sensor 16*a* disposed in the delivery pipe 16, and supplies a fuel amount corresponding to the that injected through the injectors 18, 20, 22, 24 to the fuel distributor path 16*c* without causing excessive or insufficient supply. In this case, excessive fuel is not supplied to the fuel distributor path 16*c*, and is not returned to the fuel tank 4 from the relief valve 28.

The quantitative pressure pumping processing executes a process for supplying a constant amount of the fuel in excess of the fuel injection amount from the high pressure supply pump 12 to the fuel distributor path 16*c* irrespective of the fuel injection amount and the fuel pressure detected by the fuel pressure sensor 16*a*. For example, fuel is supplied by the high pressure supply pump 12 under the condition of the maximum feed amount. Therefore, fuel is always returned to the fuel tank 4 from the relief valve 28 during the quantitative pressure pumping processing.

Figure 2:
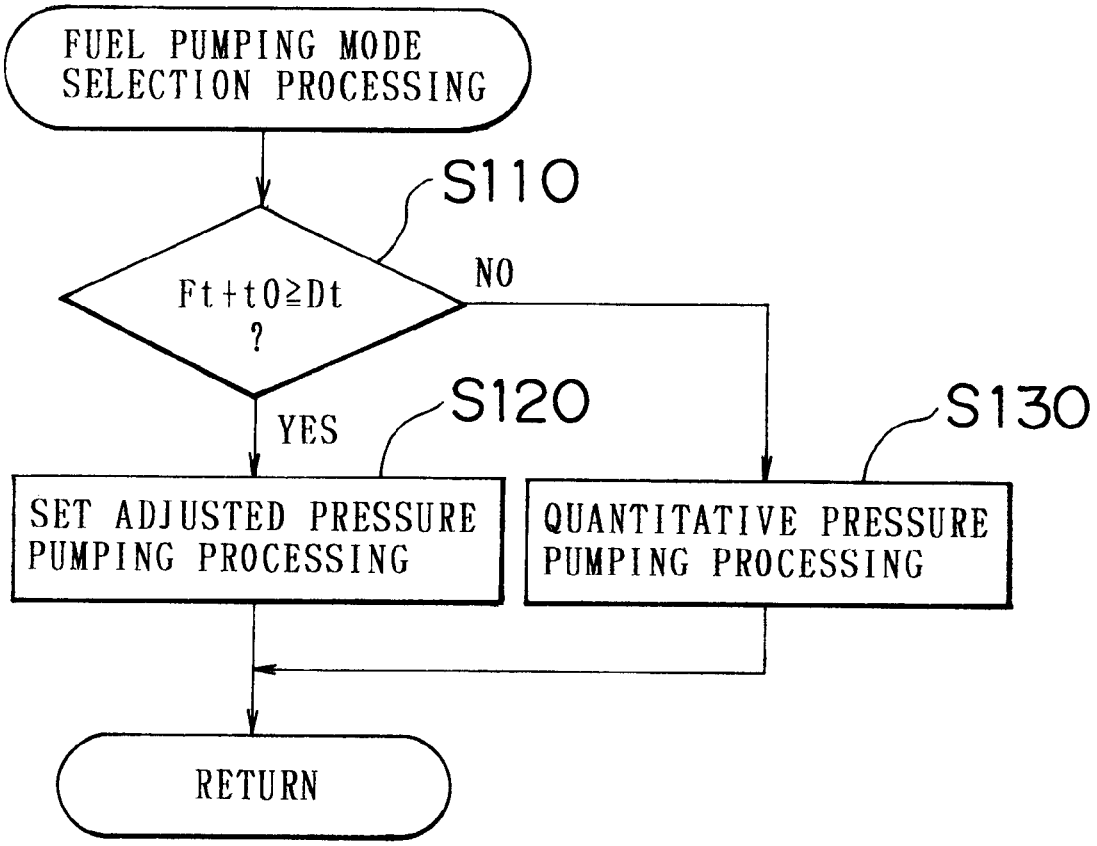
FIG. 2 is a flowchart for a fuel pumping mode selection process executed in a first embodiment.

The adjusted pressure pumping processing and the quantitative pressure pumping processing are selectively set by the fuel pumping mode selection process shown in the flowchart in FIG. 2. The fuel pumping mode selection process is repeatedly executed in a time cycle. Steps in flowcharts corresponding to individual processing are prefixed by the capital letter S.

Upon start of the fuel pumping mode selection process, it is determined whether or not the relation between a fuel temperature Ft in the fuel tank 4 detected by the fuel temperature sensor 4*a* and a fuel temperature Dt detected by the fuel temperature sensor 16*b* detected at the position furthest from the fuel supply portion in the fuel distributor path 16*c* satisfies the following equation 1 (S110).

$$Ft+t0 \geqq Dt \qquad \text{Equation 1}$$

Here, the reference temperature difference value t0 is a positive value, based on which execution of either the adjusted pressure pumping processing or the quantitative pressure pumping processing is determined. It can be considered that the fuel temperature Ft detected by the fuel temperature sensor 4*a* provided in the fuel tank 4 substantially represents the temperature of the fuel which is initially supplied from the fuel supply portion 14 to the fuel distributor path 16*c*. Therefore, judgment derived from equation 1 indicates a region of the fuel temperature distribution in the fuel distributor path 16*c* represented by the temperature of the fuel distributed to the injector 18 in the vicinity of the fuel supply portion 14*a* and the temperature of the fuel distributed to the injector 24 furthest therefrom.

If equation 1 is satisfied, it can be determined that the fuel temperature distribution in the fuel distributor path 16*c* is reduced, and if the expression 1 is not satisfied, it can be determined that the fuel temperature distribution in the fuel distributing path 16*c* is wider than the allowable range.

When equation 1 is satisfied (the fuel temperature distribution is narrower than the allowable range), that is, when the fuel temperature Dt of the fuel distributor path 16*c* does not exceed the fuel temperature Ft in the fuel tank 4 by the reference temperature difference value t0 even if thermal energy is given to the delivery pipe 16 form the gasoline engine ("YES" in S110), the adjusted pressure pumping processing is selected (S120). Therefore, the fuel pressure in the fuel distributor path 16*c* is maintained, an amount of fuel necessary for securing the injection amount of the respective injectors 18, 20, 22, 24 is always supplied to the fuel distributor path 16*c* by the high pressure supply pump 12.

Meanwhile, when the relation of equation 1 is not satisfied (the fuel temperature distribution is wider than the allowable range), that is, the fuel temperature Dt exceeds the fuel temperature Ft by at least the reference temperature difference value t0 due to thermal energy given to the delivery pipe 16 from the gasoline engine ("NO" in S110), the quantitative pressure pumping processing is selected (S130). Therefore, excessive fuel exceeding the fuel amounts injected from the injectors 18, 20, 22, 24 is always supplied to the fuel distributor path 16*c*. This excessive fuel is always discharged to the fuel tank 4 from the relief valve 28.

In some cases, when the flow rate of the fuel flowing through the fuel distributor path 16*c* is increased by switching the processing from the adjusted pressure pumping processing (S120) to the quantitative pressure pumping processing (S130), the fuel temperature Dt detected by the fuel temperature sensor 16*b* is lowered to select the adjusted pressure pumping processing again (S120) by satisfying equation 1 ("YES" in S110). Further in the thus selected adjusted pressure pumping processing (S120), the flow rate of the fuel flowing through the fuel distributor path 16*c* is decreased to increase the fuel temperature Dt detected by the fuel temperature sensor 16*b*. As a result, equation 1 is not satisfied ("NO" in S110), the processing is switched to the quantitative pressure pumping processing (S130). The adjusted pressure pumping processing (S120) and the quantitative pressure pumping processing (S130), thus, might be repeatedly executed in the aforementioned manner.

However, despite the above variation in fuel temperature, hunting may be negligible because such variation does not occur abruptly but gently over a long cycle period. If the reference temperature difference value t0 is set to a relatively low value, equation 1 can be kept satisfied while the quantitative pressure pumping processing (S130). Therefore, hunting can be suppressed.

According to the above described first embodiment, the following effects can be obtained.

When the temperature distribution of the fuel flowing through the delivery pipe 16 detected by the fuel temperature sensors 4*a* and 16*b* exceeds the allowable range, the ECU 26 adjusts the high pressure supply pump 12 so as to increase the flow rate of the fuel flowing through the delivery pipe 16 to an amount exceeding the fuel amount injected from the injectors 18 to 24. With this adjustment, the amount of the fuel flowing through the delivery pipe is greatly increased, a temperature rise rate due to the calorific power of the gasoline engine is reduced, and the fuel temperature distribution is narrowly reduced as a whole. In this case, the temperature distribution is narrowly suppressed to a lower temperature side (fuel temperature side at the fuel supply portion).

Therefore, a difference between the output torque of adjacent cylinders is reduced, and a revolution variation of the gasoline engine is suppressed or prevented.

Since the relief valve 28 is mounted to the delivery pipe 16 at the side opposite to the side to which the fuel supply path 14 supplies fuel, stagnant fuel in the fuel distributor path 16*c* is reduced and fuel flows smoothly especially during the quantitative pressure pumping processing. Therefore, a stagnant portion of fuel is reduced or eliminated and such stagnant fuel is not, therefore, heated to a high temperature and the fuel temperature distribution in the delivery pipe 16 can be narrowed down. This is effective for reducing the revolution variation in the gasoline engine.

Second Embodiment

Figure 3:
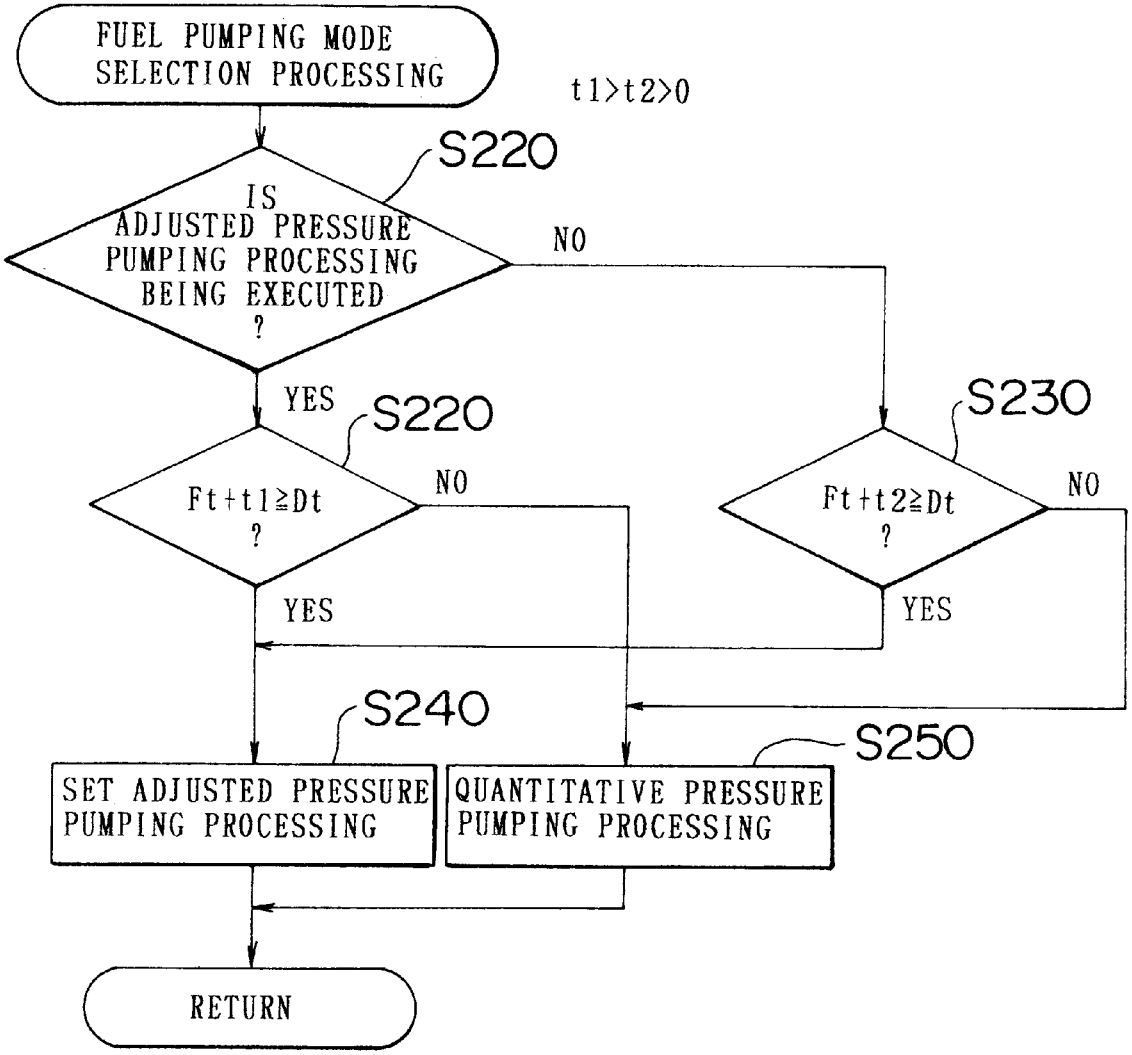
FIG. 3 is a flowchart for a fuel pumping mode selection process executed in a second embodiment.

The second embodiment is substantially the same as the first embodiment except that a fuel pumping mode selection process shown in FIG. 3 is executed instead of the fuel pumping mode selection process shown in FIG. 2.

Upon start of the fuel pumping mode selection process in FIG. 3, whether or not the adjusted pressure pumping processing is being executed is determined (S210). If the adjusted pressure pumping processing is being executed ("YES" in S210), it is determined whether or not the relation between the fuel temperature Ft in the fuel tank 4 detected by the fuel temperature sensor 4*a* and the fuel temperature Dt of the delivery pipe 16 detected by the fuel temperature sensor 16*b* satisfies the following equation 2 (S220):

$$Ft+t1 \geqq Dt \qquad \text{Equation 2}$$

Here, the reference temperature difference value t1 is a positive value, based on which execution of the adjusted pressure pumping processing or the quantitative pressure pumping processing is determined in accordance with the difference in the fuel temperature. If equation 2 is satisfied, this indicates that the fuel temperature distribution in the delivery pipe 16 is narrower than the allowable range, and if equation 2 is not satisfied, this indicates that the fuel temperature distribution in the delivery pipe 16 is wider than the allowable range like the first embodiment.

When the relation of the expression 2 is satisfied (the fuel temperature distribution is narrower than the allowable range), that is, the fuel temperature Dt does not exceed the fuel temperature Ft in the fuel tank 4 by the reference temperature difference value t1 in spite of thermal energy given to the delivery pipe 16 from the gasoline engine ("YES" in S220), the adjusted pressure pumping processing is selected (S240). Accordingly the fuel pressure in the delivery pipe 16 is maintained and the required amount of the fuel for securing the injection amount of the injectors 18, 20, 22, 24 is always supplied to the delivery pipe 16 from the high pressure supply pump 12.

Meanwhile when the relation of equation 2 is not satisfied (the fuel temperature distribution is wider than the allowable range), that is, when the fuel temperature Dt exceeds the fuel temperature Ft by the reference temperature difference value t1 due to thermal energy given to the delivery pipe 16 from the gasoline engine ("NO" in S220), the quantitative pressure pumping processing is selected (S250). Therefore, excessive fuel exceeding the fuel amount injected from the injectors 18, 20, 22, 24 is always supplied to the delivery pipe 16, and the excessive fuel is always discharged from the relief valve 28 to the fuel tank 4.

If the quantitative pressure pumping processing is once selected (S250), in the next control synchronism, it is judged as "NO" in step S210 and then, it is determined whether or not the relation between the fuel temperature Ft in the fuel tank 4 detected by the fuel temperature sensor 4*a* and the fuel temperature Dt detected by the fuel temperature sensor 16*b* satisfies the following equation 3 (S230).

$$Ft+t2 \geqq Dt \qquad \text{Equation 3}$$

Here, the reference temperature difference value t2 is a positive value, based on which execution of either the adjusted pressure pumping processing or the quantitative pressure pumping processing is determined in accordance with the difference in the fuel temperature. The reference temperature difference value t2 is smaller than the reference temperature difference value t1 used in the adjusted pressure pumping processing.

When the relation of equation 3 is satisfied (the fuel temperature distribution is narrower than the allowable range), that is, when the fuel temperature Dt does not exceed the fuel temperature Ft in the fuel tank 4 by the reference temperature difference value t2 despite thermal energy given to the delivery pipe 16 from the gasoline engine ("YES" in S230), the adjusted pressure pumping processing is selected (S240). This returns the state where the fuel pressure in the delivery pipe 16 is maintained and the amount of the fuel required for securing the injection amount of the injectors 18, 20, 22, 24 is always supplied to the delivery pipe 16 from the high pressure supply pump 12.

Meanwhile, when the relation of equation 3 is not satisfied (the fuel temperature distribution is wider than the allowable range), that is, the fuel temperature Dt exceeds the fuel temperature Ft by the reference temperature difference value t2 due to calorific power given to the delivery pipe 16 from the gasoline engine ("NO" in S230), the quantitative pressure pumping processing is maintained (S250). This processing, thus, maintains the state where the excessive fuel exceeding the fuel amount injected from the injectors 18, 20, 22, 24 is always supplied to the delivery pipe 16, and the excessive fuel is always discharged from the relief valve 28 to the fuel tank 4.

According to the aforementioned second embodiment, the same function and effect as those described in the first embodiment can be obtained.

Judgment of equation 2 is executed during adjusted pressure pumping processing, and judgment of equation 3 is executed during quantitative pressure pumping processing. Here, as the reference temperature deference value t2 is smaller than the reference temperature deference value t1, even if the fuel temperature Dt of the delivery pipe 16 is decreased by switching the processing from the adjusted pressure pumping processing to the quantitative pressure pumping processing, the state is not immediately judged as "YES" in step S230. Accordingly it is possible to suppress the hunting between the adjusted pressure pumping processing and the quantitative pressure pumping processing, allowing rapid suppression of revolution variation.

Third Embodiment

Figure 4:
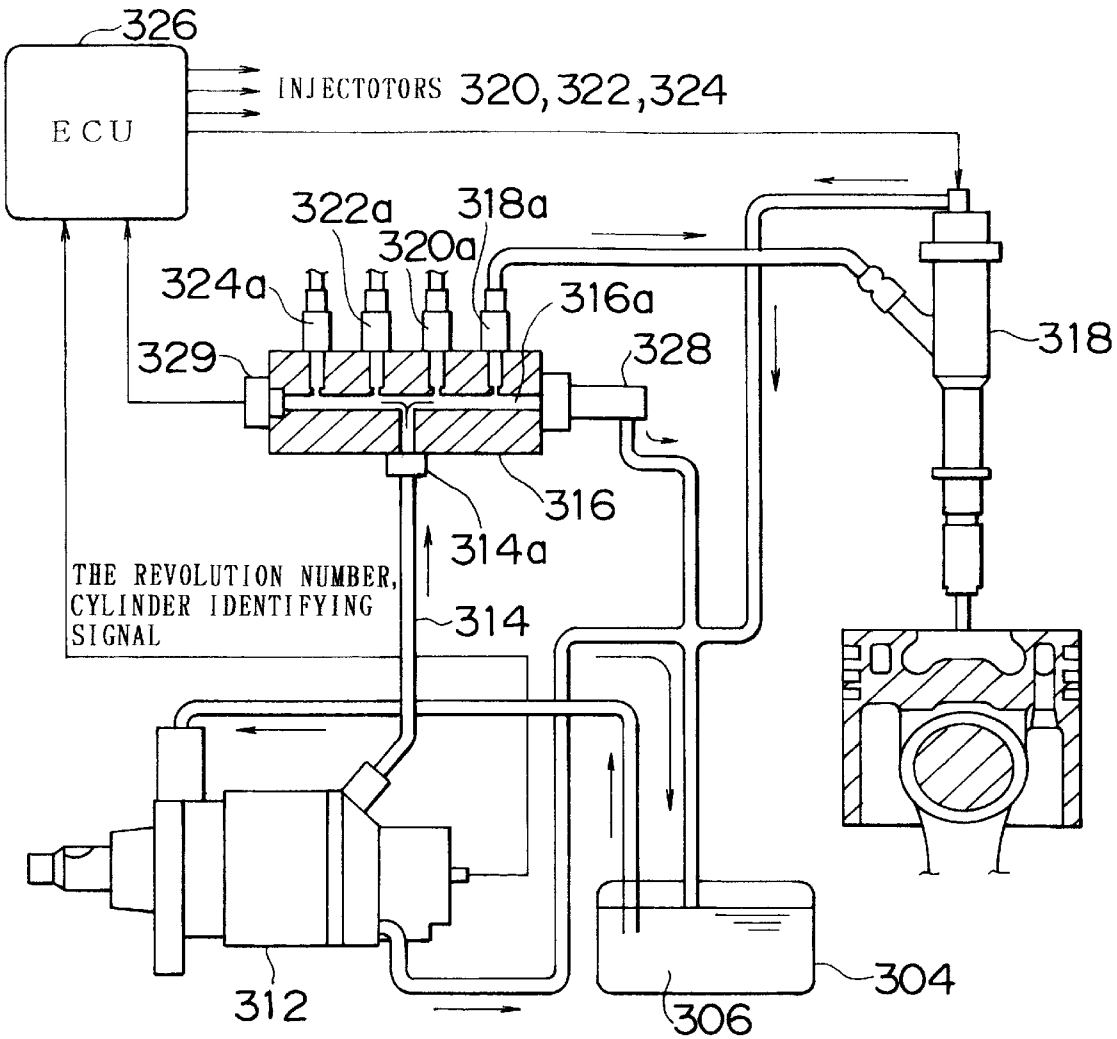
FIG. 4 is a block diagram of a fuel system of a third embodiment applied to a four-cylinder diesel engine.

FIG. 4 is a block diagram of a fuel system of the third embodiment applied to a four-cylinder diesel engine.

Referring to FIG. 4, fuel 806 in a fuel tank 304 is pumped up by a fuel pump 312 and highly pressurized and supplied into a delivery pipe 316 (corresponding to the fuel distributor pipe) from a fuel supply path 314 through a fuel supply portion 314*a*.

In the delivery pipe 316, fuel branch portions 318*a*, 320*a*, 322*a* and 324*a* to the corresponding injectors 318, 320, 322, 324 are aligned along a fuel distributor path 316*a*. The fuel supply portion 314*a* supplies fuel to the fuel distributor path 316*a* from a center position between two center branch portions 320*a* and 322*a* of the four fuel branch portions 318*a* to 324*a*.

After reaching the respective injectors 318 to 324 through the fuel branch portions 318*a* to 324*a*, the fuel is directly injected to the corresponding cylinders. Valve-opening timing and valve-opening period of each of the injectors 318 to 324 are adjusted in accordance with the driving state of the diesel engine by an ECU 326.

One end of the fuel distributor path 316*a* of the delivery pipe 316 is provided with a relief valve 328 for discharging the excessive fuel of the one supplied from the fuel pump 312 which is more than the fuel amount injected from the injectors 318 to 324 to the fuel tank 304. At the other end of the fuel distributor path 316*a* opposite to the end where the relieve valve 328 is provided, a fuel pressure sensor 329 is disposed for detecting fuel pressure within the fuel distributor path 316*a*.

The fuel pump 312 is obtained by combining the feed pump 8, the filter 10 and the high pressure supply pump 12 of the first embodiment, which functions in the similar manner.

The ECU 326 has the same structure as that of the ECU 26 of the first embodiment, and functions in the same manner. Among the processes executed by the CPU in the ECU 326, the fuel supply control to the delivery pipe 316 is executed by the fuel pump 312 in the same manner as the first embodiment.

According to the aforementioned third embodiment, the following effects can be obtained.

As described above, the fuel supply portion 314*a* is formed at a position between the two central fuel branch portions 320*a* and 322*a* from where the fuel is directed to left side and right side for distribution to the fuel distributor path 316*a*. Therefore, the fuel flowing from the fuel supply portion 314*a* to pass through 4 fuel branch portions 318*a* to 324*a* reaches the fuel branch portion 320*a* of the second cylinder and the fuel branch portion 322*a* of the third cylinder. The fuel then reaches the fuel branch portions 318*a* and 324*a* of the corresponding the first and the fourth cylinders.

That is, the fuel to be supplied to the second and third cylinders stays in the delivery pipe 316 in a shorter period as compared with the fuel to be supplied to the first and fourth cylinders. As a result, the temperature of the fuel to be supplied to the first and fourth cylinders is higher than the temperature of the fuel to be supplied to the second and third cylinders.

The ignition order of the four cylinders is "first cylinder-third cylinder-fourth cylinder-second cylinder". Therefore, the order of temperatures of fuel to be supplied to the cylinders is "high-low-high-low". A fuel temperature difference between a cylinder and the preceding cylinder has the same absolute value and opposite sign of the fuel temperature difference between the cylinder and the subsequent cylinder (the difference between absolute values assumes 0).

The fuel is expanded larger as the temperature is higher and therefore, the output torque becomes lower as the temperature is higher if the injection volume is the same. Therefore, the order of output torque becomes "small-large-small-large". With such a repetition, variation cycle of the output torque becomes small, and influence on the revolution variation of the diesel engine becomes substantially small. Therefore the revolution variation of the diesel engine is suppressed or prevented.

If the fuel supply portion 314*a* exists at the position of the fuel pressure sensor 329, temperature of fuel to be supplied to the fourth cylinder becomes lowest, and the fuel temperature becomes higher in the order of the third cylinder, the second cylinder and the first cylinder. Therefore, temperature of fuel to be supplied to the cylinders becomes "high-medium-low-low-medium-high" in the order of ignition, and the order of output torque becomes "small-medium-large-large-medium-small". Thus, the variation cycle is elongated, and the revolution variation of the diesel engine can not be suppressed.

In the case of a six-cylinder engine, even if the fuel is supplied from the central portion of the delivery pipe, i.e., between the fuel branch portion of the third cylinder and the fuel branch portion of the fourth cylinder as in the third embodiment, the fuel temperature takes the cycle of three patterns of "high-medium-low-medium-high". Therefore, even if the ignition order is arbitrarily changed, the fuel temperature difference between adjacent cylinders does not take such cycle as "(+large) (−large) (+large) . . . " and thus, the revolution variation of the diesel engine is not suppressed or prevented.

If a length of the delivery pipe 316 is appropriately adjusted such that pulse wave at a fuel supply pressure generated in the delivery pipe 316 compensates the pulse wave reflected by opposite ends of the delivery pipe 316 by admitting the fuel from the fuel supply portion 314*a*, pulse noise can be reduced.

Fourth Embodiment

Figure 5:
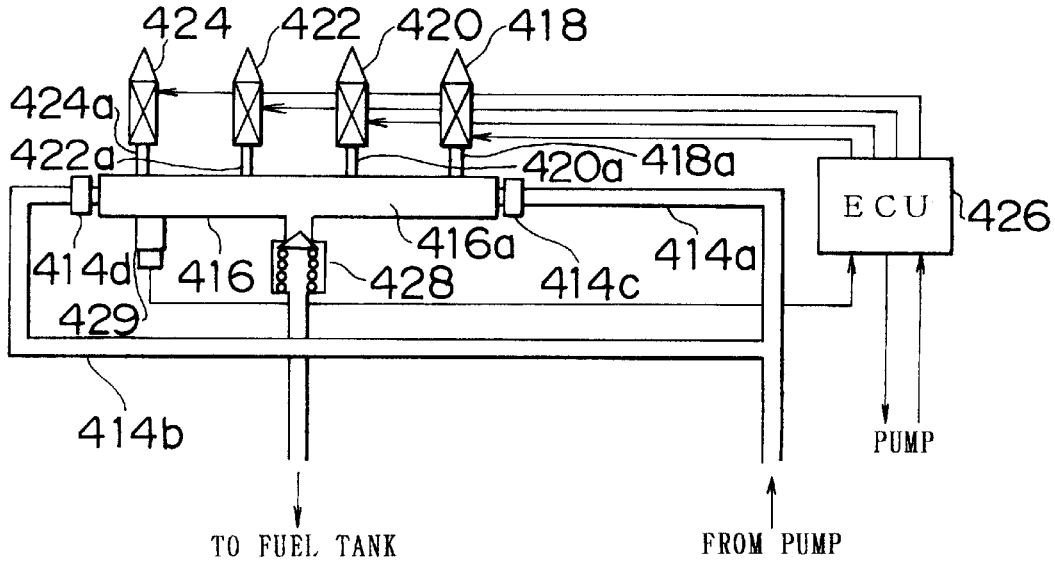
FIG. 5 is a block diagram of a fuel system of a fourth embodiment mainly representing a delivery pipe.

As shown in FIG. 5, in a delivery pipe 416 (corresponding to the fuel distributor pipe) similar to the in the fourth embodiment, fuel branch portions 418*a*, 420*a*, 422*a*, 424*a* to the injectors 418, 420, 422, 424 are aligned along the fuel distributing path 416*a* in the same manner as the third embodiment. Fuel is supplied to the delivery pipe 416 from the fuel supply path 414*a* and 414*b* through the fuel supply portions 414*c* and 414*d* mounted at opposite ends of the delivery pipe 416.

A relief valve 428 is provided at a central portion of the fuel branch portions 418*a* to 424*a* leading to the four injectors 418 to 424, i.e., between the fuel branch portions 420*a* and 422*a* to the two injectors 420 and 422 as a discharging position for discharging excessive fuel in the delivery pipe 416. Valve opening timing and valve opening period of the injectors 418 to 424 are adjusted in accordance the driving state of the diesel engine.

The delivery pipe 416 is provided with a fuel pressure sensor 429 for detecting fuel pressure in the fuel distributor path 416*a*. Other structures are the same as those of the third embodiment.

According to the above described fourth embodiment, the following effects can be obtained.

As described above, the fuel supply portions 414*c* and 414*d* are formed at opposite ends of the delivery pipe 416 as supply portions, and fuel is supplied to the fuel distributor path 416*a* in the delivery pipe 416 from its left and right ends toward its center. Therefore, the fuel moves from the fuel supply portions 414*c* and 414*d* to the four fuel branch portions 418*a* to 424*a* such that the fuel first reaches the fuel branch portion 418*a* of the first cylinder and the fuel branch portion 424*a* of the fourth cylinder and then, the fuel reaches the fuel branch portion 420*a* of the second cylinder and the fuel branch portion 422*a* of the third cylinder.

That is, the time for the fuel supplied to the first and fourth cylinders to stay in the delivery pipe 416 is shorter than the time for the fuel supplied to second and third cylinders to stay in the delivery pipe 416. As a result, the temperature of the fuel to be supplied to the second and third cylinders is higher than the temperature of the fuel supplied to the first and fourth cylinders.

As described in the third embodiment, the ignition order of the four cylinders takes such cycle as "first cylinder-third cylinder-fourth cylinder-second cylinder". Therefore, the order of temperatures of fuel to be supplied to the cylinders is "low-high-low-high". A fuel temperature difference between one cylinder and the preceding cylinder has the same absolute value and opposite sign of the temperature difference between the cylinder and the subsequent cylinder (the difference between absolute values assumes 0).

For the same reason as described in the third embodiment, the output torque is lowered as the temperature is higher. Therefore, the order of the output torque takes the cycle as "large-small-large-small". With such a repetition, variation cycle of the output torque is shortened, and the revolution variation in the diesel is less influenced. Therefore the revolution variation in the diesel engine is suppressed or prevented.

In the case of a six-cylinder engine, even if the fuel is supplied from the opposite ends of the delivery pipe as in the fourth embodiment, the fuel temperature takes the cycle of such pattern as "low-medium-high-high-medium-low". Therefore, even if the ignition order is changed arbitrarily, the fuel temperature difference between adjacent cylinders does not take the cycle as "(+large) (−large) (+large) . . . " and thus, the revolution variation in the diesel engine is not suppressed or prevented.

Fifth Embodiment

Figure 6:
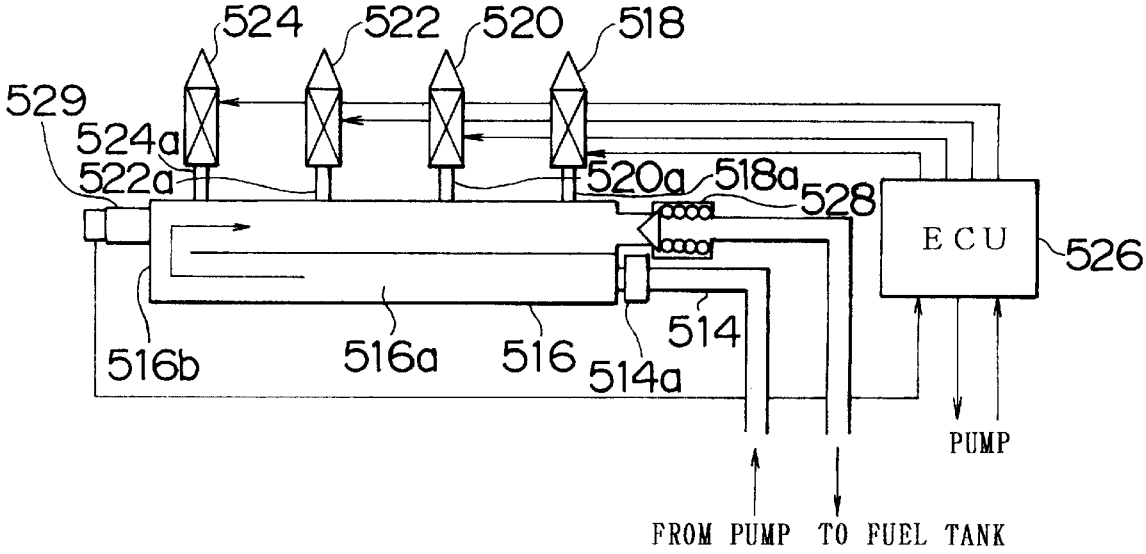
FIG. 6 is a block diagram of a fuel system of a fifth embodiment mainly showing a delivery pipe.

As shown in FIG. 6, a fuel distributor path 516*a* (corresponding to a fuel path of a fuel distributor pipe) of a delivery pipe 516 (corresponding to the fuel distributor pipe) of the fifth embodiment is formed so as to be bent into a U-shaped in the delivery pipe 516 and therefore, a length of the fuel distributor pipe is twice longer than that of the delivery pipe 516.

Fuel branch portions 518*a,* 520*a,* 522*a,* 524*a* leading to the four injectors 518, 520, 522 and 524 are arranged in this fuel distributing path 516*a*. Fuel is supplied from a fuel supply portion 514*a* connected to one end of the fuel distributor path 516*a,* and excessive fuel which is not burnt by in the cylinders is discharged from the relief valve 528 connected to the other end of the fuel distributor path 516*a*.

Here, the fuel branch portions 518*a* to 524*a* are arranged downward of the bent portion 516*b* which is located at an intermediate portion of the fuel distributor path 516*a* (at the side of the relief valve 528). Therefore, the fuel entering from the fuel supply portion 514*a* into the fuel distributor path 516*a* flows through a path having substantially the same length as that of the delivery pipe 516 to pass through the bent portion 516*b* and then, to be distributed to the injectors 518 to 524 through the fuel branch portions 518*a* to 524*a* in this order.

Valve opening timing and valve opening period of each of the injectors 518 to 524 are adjusted by an ECU 526 in accordance with a driving state of the diesel engine. Other structures are also the same as those of the third embodiment.

According to the fifth embodiment as described above, the following effects can be obtained.

Fuel temperature rise rate in the delivery pipe 516 is high at an initial state, but the rate is gradually retarded to reach 0. That is, temperature of fuel flowing in the delivery pipe 516 hardly rises.

Therefore, if the fuel branch portions 518*a* to 524*a* are provided at the side opposite to the fuel supply portion 514*a* in the fuel distributor path 516*a,* the distance from the fuel distributor path 516*a* to the fuel branch portions 518*a* to 524*a* is elongated. The fuel is sufficiently heated in the course of flowing through the aforementioned path, and the temperature rise of fuel flowing from the fuel branch potions 518*a* to 524*a* to the cylinders is negligible. Accordingly the temperature rise of fuel to be supplied to each of the cylinders is small, and temperature distribution of the fuel supplied to the respective cylinders is narrowed down, thus suppressing or preventing revolution variation in the diesel engine.

Especially, the fuel distributor path 516*a* is provided at its intermediate portion with the bent portion 516*b* formed into U-shaped in the delivery pipe 516, and all the fuel branch portions 518*a* to 524*a* are disposed downstream from the bent portions 516*b*. Therefore, this delivery pipe 516 has a substantially longer fuel path from the fuel supply portion 514*a* to the bent portion 516*b*. Therefore, fuel flowing through this fuel path is sufficiently heated to a high temperature, and after the fuel reaches the first fuel branch portion 524*a,* the temperature rise rate is extremely lowered, and the temperature of fuel hardly rises until the fuel reaches the last fuel branch portion 518*a*. Therefore, the temperature distribution of the fuel supplied to the respective cylinders is substantially narrowed down, and the revolution deviation of the diesel engine can further be suppressed or prevented.

The upstream of the fuel distributor path 516*a* from the bent portion 516*b* is capable of absorbing thermal energy generated at the downstream from the bent portion 516*b*. This makes it possible to narrow down the temperature distribution of the fuel in the fuel distributor path 516*a,* thus further suppressing or preventing the revolution variation in the diesel engine.

Sixth Embodiment

Figure 7:
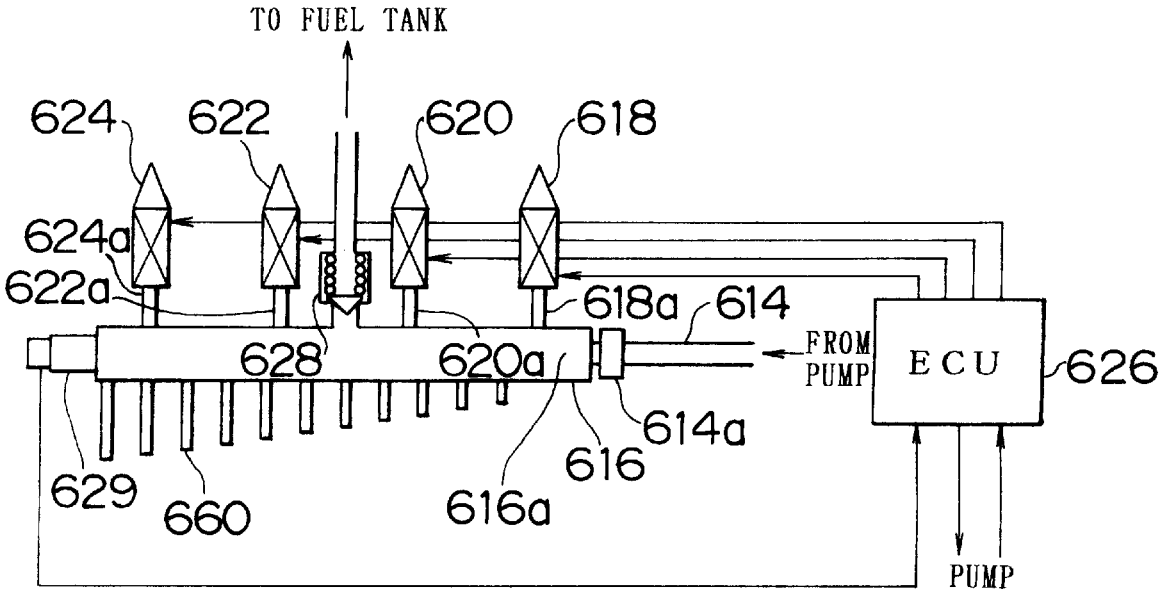
FIG. 7 is a block diagram of a fuel system of a sixth embodiment mainly showing a delivery pipe.

As shown in FIG. 7, in a fuel distributor pipe 616 (corresponding to a fuel path of a fuel distributor pipe) of the sixth embodiment, fuel branch portions 618*a,* 620*a,* 622*a,* 624*a* to the injectors 618, 620, 622, 624 are arranged along the fuel distributor path 616*a* as in the third embodiment. Fuel is supplied to this fuel distributing path 616*a* from a fuel supply portion 614*a* connected to one end of the fuel distributing path 616*a*.

A relief valve 628 is mounted to a central portion of the fuel branch portions 618*a* to 624*a* to the four injectors 618 to 624, i.e., between the fuel branch portions 620*a* and 622*a* to the two injectors 620 and 622 as discharging portion, and excessive fuel in the delivery pipe 616 is discharged. Valve opening timing and valve opening period of the respective injectors 618 to 624 are adjusted in accordance with the driving state of the diesel engine. The delivery pipe 616 is provided with a fuel pressure sensor 629 for detecting a fuel pressure in the fuel distributor path 616*a*.

The delivery pipe 616 is provided with cooling fins 660 for heat releasing. The cooling fins 660 are not disposed uniformly around the outer surface of the delivery pipe 616, but are disposed from a position slightly apart from the fuel supply portion 164*a,* and are elongated as moving away from the fuel support portion 614*a*. Other structures are the same as those in the third embodiment.

According to the above described sixth embodiment, the following effects can be obtained.

Since the delivery pipe 616 is provided with the cooling fins 660 for releasing the heat, a large amount of heat transmitted from the diesel engine to the delivery pipe 616 is discharged, and temperature rise rate of fuel flowing through the inside fuel distributor path 616*a* is lowered. Therefore, the temperature distribution of the fuel branched to the cylinders is narrowed down, and the revolution variation of the diesel engine can be suppressed.

Further, since the cooling fins 660 are elongated as they are separated away from the fuel supply portion 614*a* for enhancing the cooling ability, a portion of the delivery pipe 616 away from the fuel supply portion 614*a* is cooled more effectively. Therefore, the temperature rise rate of fuel flowing through the delivery pipe 616 is lowered, the temperature distribution of fuel branched into the cylinders is narrowed down. Thus, the revolution variation in the diesel engine can suppressed or prevented more effectively.

Seventh Embodiment

Figure 8:
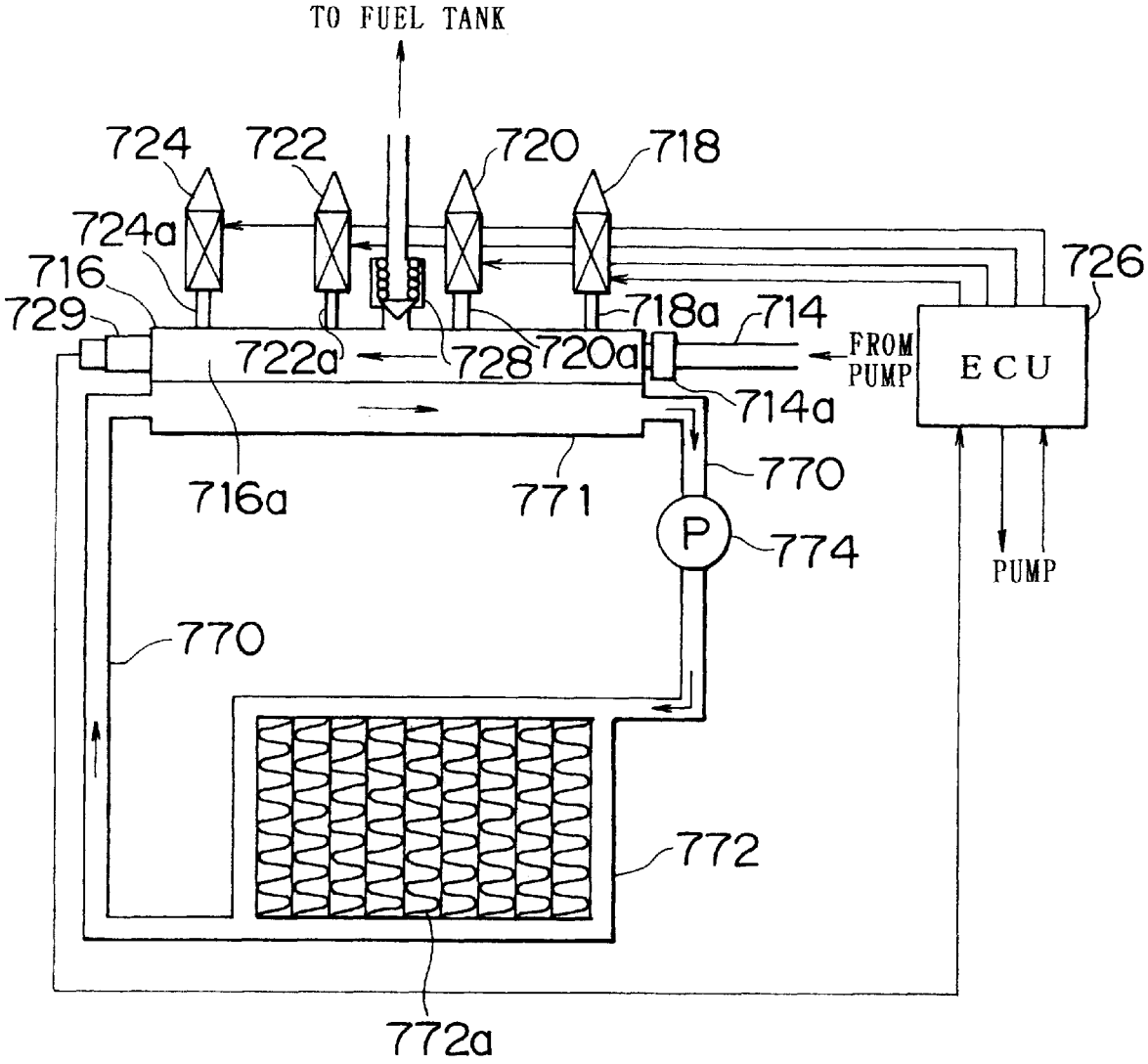
FIG. 8 is a block diagram of a fuel system of a seventh embodiment mainly showing a delivery pipe.

As shown in FIG. 8, in a fuel distributor pipe 716 (corresponding to a fuel path of a fuel distributor pipe) of the seventh embodiment, fuel branch portions 718*a,* 720*a,* 722*a,* 724*a* to the injectors 718, 720, 722, 724 are aligned along the fuel distributor path 716*a* as in the third embodiment. Fuel is supplied to the fuel distributor path 716*a* from a fuel supply path 714 through a fuel supply portion 714*a* connected to one end of the fuel distributor path 716*a*.

As in the sixth embodiment, a relief valve 728 is mounted to a central portion of the fuel branch portions 718*a* to 724*a* leading to the four injectors 718 to 724, that is, a position between 720*a* and 722*a,* as a discharging portion, from where excessive fuel in the delivery pipe 716 is discharged. Valve opening timing and valve opening period of each of the injectors 718 to 724 are adjusted by the ECU 726 in accordance with the driving state of the diesel engine. The delivery pipe 716 is provided with a fuel pressure sensor 729 for detecting a pressure of fuel in the delivery pipe 716.

A coolant circulation path 770 (corresponding to cooling means) is disposed partially along the delivery pipe 716. The coolant circulation path 770 is formed of an endothermic path 771 for absorbing heat generated in the delivery pipe 716 by heat conduction, an heat exchanger 772 including a corrugate fin 772*a* for exchanging heat between the heat exchanger 772 and air, and a pump 774 for circulating the coolant (corresponding to cooling conductor) in the coolant circulation path 770.

The pump 774 directs the flow of the coolant to be opposite against the flow of the fuel in the fuel distributor path 716*a* of the delivery pipe 716 on the endothermic path 771.

According to the above described seventh embodiment, the following effects can be obtained.

Coolant in the endothermic path 771 in contact with the delivery pipe 716 absorbs heat of the delivery pipe 716 and releases the heat by the heat exchanger 772. Therefore, the temperature rise rate of fuel flowing through the fuel distributor path 716*a* is lowered, and the temperature distribution of fuel branched to the cylinders is narrowed down. Therefore, the revolution variation in the diesel engine can be suppressed or prevented.

Further, in the endothermic path 771, since the coolant flows in opposite direction of the fuel flowing in the fuel distributor path 716*a,* the fuel is substantially cooled as the fuel flows in the delivery pipe 716 away from the fuel supply portion 714*a* for a longer time. Therefore, the temperature distribution of fuel branched to the cylinders can further be narrowed down, and the revolution variation in the diesel engine can further be suppressed or prevented.

Other embodiments

In the first and the second embodiments, the temperature distribution in the fuel distributor path 16*c* may be detected by providing a fuel temperature sensor in the fuel supply portion 14*a* or the delivery pipe 16 in the vicinity thereof together with the fuel temperature sensor 16*b* disposed at the relief valve 28 in place of the fuel temperature sensor 4*a* in the fuel tank 4.

The quantitative pressure pumping processing (for example, sending fuel under the maximum pressure) is executed when the temperature distribution of fuel is wide in the first and the second embodiments. Since excessive amount of fuel more than the fuel injection amount is supplied to the delivery pipe, a fuel in an amount corrected to increase with respect to the fuel injection amount (for example, twice the fuel injection amount) may be supplied from the high pressure supply pump to the delivery pipe. The same can be the in the eighth embodiment.

Figure 9:
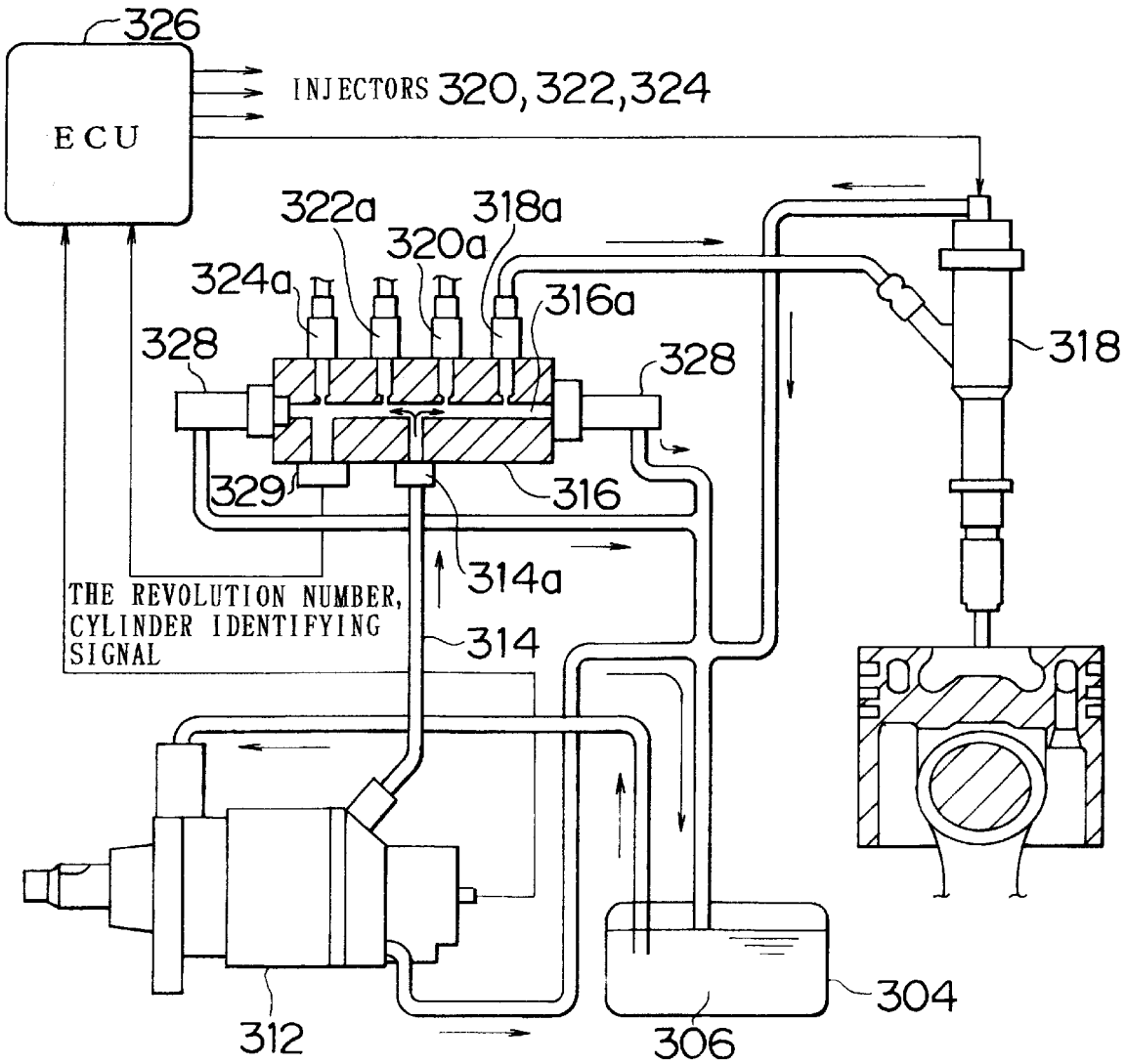
FIG. 9 is a block diagram of a fuel system of a modified example of the third embodiment.

Although the relief valve is mounted on one end of the fuel distributor path in the third embodiment, relief valves 328 may be provided on opposite ends of the fuel distributor path 316*a* as shown in FIG. 9. If the relief valves 328 are provided on the opposite ends, when a fuel exceeding the injection amount is supplied to the fuel distributor path 316*a,* stagnation of the fuel is especially reduced and thus, the temperature distribution can be narrowed down, which is more effective for suppressing or preventing the revolution variation in the diesel engine.

The cooling fins 660 for releasing the heat are provided on the delivery pipe 616 in the sixth embodiment. Instead of this, a heat insulator exhibiting heat-insulating ability that is enlarged as separating away from the fuel supply portion, or heat transmitting means exhibiting heat-transmitting ability that is enlarged as approaching the fuel supply portion may be provided on an outer surface of the delivery pipe.

Although the fuel is injected from the injectors directly into the cylinders in the respective embodiments, the present invention can be applied to a type in which the fuel is injected to an intake port.

The first, second and eighth embodiments show examples of gasoline engine, but these embodiments can also be applied to a diesel engine for providing the same function and effect. Further, the third to seventh embodiments show examples of the diesel engine, these embodiments can also be applied to the gasoline engine for providing the same function and effect.

What is claimed is:

1. A fuel system comprising:

a fuel distributor pipe having a relief valve for discharging excessive fuel therefrom, and for distributing and supplying fuel from a fuel supply source to each of a plurality of cylinders, fuel temperature distribution detecting means for detecting a temperature distribution of fuel in the fuel distributor pipe; and fuel flow rate adjusting means for increasing a flow rate of fuel supplied from the fuel supply source to the fuel distributor pipe when the detected fuel temperature distribution exceeds an allowable range, the increased fuel flow rate being greater than a standard fuel flow rate administered when the temperature distribution does not exceed the allowable range.

2. A fuel system according to claim 1, wherein the fuel flow rate administered when the detected fuel temperature distribution does not exceed the allowable range corresponds to an amount of fuel required by the cylinders and the increased fuel flow rate administered when the detected fuel temperature distribution exceeds the allowable range is greater than an amount of fuel required by the cylinders.

3. A fuel system according to claim 2 further comprising:

fuel flow rate judgment means for judging whether the fuel flow rate corresponds to the fuel amount required by the plurality of cylinders, wherein the allowable range is varied based on the judgment result made by the fuel flow rate judgment means.

4. A fuel system according to claim 1, wherein the relief valve is mounted at one end of the fuel distributor pipe, and fuel supplied from the fuel supply source is received by the other end of the fuel distributor pipe.

5. A fuel system according to claim 1, further comprising a fuel supply portion for supplying fuel to the fuel distributor pipe such that fuel is distributed to the cylinders by one of two paths, each path corresponding to a fuel delivery temperature and wherein the two paths extend to the cylinders so that the fuel for each of the two delivery temperatures is delivered to the respective cylinders in an alternating pattern corresponding to an ignition order of the cylinders.

6. A fuel system according to claim 5, wherein the fuel supply portion supplies fuel to the fuel distributor pipe from a position where a fuel temperature difference between a cylinder a and a cylinder b which precedes the cylinder a in the ignition order is small in absolute value and is of opposite sign of a fuel temperature difference between the cylinder a and a cylinder c which is subsequent to the cylinder a in the ignition order.

7. A fuel system according to claim 5, wherein the fuel distributor pipe is mounted in a four-cylinder internal combustion engine for fuel distribution to four cylinders, and the fuel supply portion supplies fuel from both sides of the fuel distributor pipe.

8. A fuel system according to claim 5, wherein the fuel distributor pipe mounted in a four-cylinder internal combustion engine for fuel distribution to four cylinders, and the fuel supply portion supplies fuel to the fuel distributor pipe from an intermediate position that divides the four cylinders into two groups each containing two cylinders.

9. A fuel system according to claim 1, further comprising:

a fuel supply portion for supplying fuel from one end of the fuel distributor pipe; and a plurality of fuel branch portions, each branch portion leading to a respective one of the cylinders which is located opposite to the fuel supply portion in a fuel path of the fuel distributor pipe.

10. A fuel system according to claim 9, wherein a fuel path in the fuel distributor pipe is formed into a U-like shape having a bent portion at an intermediate part thereof, and all of the fuel branch portions are disposed downstream of the bent portion.

11. A fuel system according to claim 1, further comprising:

a fuel supply portion for supplying fuel to the fuel distributor pipe; and cooling means mounted on an outer surface of the fuel distributor pipe, for cooling fuel within the fuel distributor pipe, a cooling ability of the cooling means being enhanced as a distance from the fuel supply portion increases.

12. A fuel system according to claim 11, wherein the cooling means is formed as a cooling fin having a surface area enlarged as a distance from the fuel supply portion increases.

13. A fuel system according to claim 11, wherein the cooling means includes a circulating path for circulating a coolant and wherein part of the circulating path is arranged to be thermally conductive with the fuel distributor pipe, and fuel in the fuel distributor pipe is cooled by a heat exchanger disposed in a part of the circulation path.

14. A fuel system according to claim 13, wherein the coolant flows in a direction opposite to a flow direction of fuel in the part of the circulating path in which thermal conduction occurs between the circulation path and the fuel distributor pipe.

15. A fuel system comprising:

a fuel distributor pipe having a relief valve for discharging excessive fuel, the fuel distributor pipe distributing and supplying fuel from a fuel supply source to a plurality of cylinders;

fuel supply means for supplying fuel to the fuel distributor pipe; and fuel supply control means for controlling the fuel supply means such that fuel is discharged from the relief valve while maintaining a desired fuel pressure within the fuel distributor pipe based on a temperature distribution in the fuel distributor pipe.

* * * * *